US006366010B1

(12) United States Patent
Suganuma et al.

(10) Patent No.: US 6,366,010 B1
(45) Date of Patent: Apr. 2, 2002

(54) FRAME FOR A COLOR SELECTION MECHANISM FOR A CATHODE RAY TUBE

(75) Inventors: Atsuro Suganuma, Kanagawa (JP); Shih Chieh Yao, Singapore (SG)

(73) Assignee: Sony Electronics (Singapore) Pte, Ltd., Singapore (SG)

( * ) Notice: Subject to any disclaimer, the term of this patent is extended or adjusted under 35 U.S.C. 154(b) by 0 days.

(21) Appl. No.: 09/465,597

(22) Filed: Dec. 17, 1999

(51) Int. Cl.[7] ..... H01J 29/07
(52) U.S. Cl. ..... 313/407; 313/402
(58) Field of Search ..... 313/402, 403, 313/407

(56) References Cited

U.S. PATENT DOCUMENTS 5,072,151 A * 12/1991 Spina ..... 313/407
5,382,871 A * 1/1995 Funahashi et al. ..... 313/402
5,631,520 A * 5/1997 Inoue et al. ..... 313/402
5,949,183 A * 9/1999 Saita et al. ..... 313/407

OTHER PUBLICATIONS

Patent Abstracts Of Japan vol. 1995, No. 11, Dec. 26, 1995 & JP 07 211244 A (Hitachi Ltd;Others: 01) Aug. 11, 1995.*
Patent Abstracts Of Japan vol. 1999, No. 02, Feb. 26, 1999 & JP 10 302665 A (Sony Corp), Nov. 13, 1998.*
Patent Abstracts Of Japan vol. 1997, No. 02, Feb. 28, 1997 & JP 08 270334 A (Nippon Paper Ind Co Ltd), Oct. 15, 1996.*

* cited by examiner

*Primary Examiner*—Nimeshkumar D. Patel
*Assistant Examiner*—Thelma Sheree Clove
(74) *Attorney, Agent, or Firm*—Frommer Lawrence & Haug LLP; William S. Frommer; Matthew K. Ryan

(57) ABSTRACT

A color selection mechanism for a color CRT includes a frame to which a color selection electrode thin plate is to be applied, and a color selection thin plate. The surface of the frame to which the color selection electrode thin plate is to be applied is formed from a face represented by a first and a second function in a longitudinal direction from the center axis of the frame. The surface is leftwardly and rightwardly symmetrical with respect to the center axis.

11 Claims, 3 Drawing Sheets

FRAME FOR A COLOR SELECTION MECHANISM FOR A CATHODE RAY TUBE

FIELD OF THE INVENTION

The invention relates to a frame for a color selection mechanism for use in a cathode ray tube.

BACKGROUND OF THE INVENTION

A conventional color selection mechanism 1 for a cathode ray tube (CRT) is shown in FIG. 1. From FIG. 1 it can be seen that the color selection mechanism 1 comprises an aperture grill 10 which includes a number of narrow belt-shaped grid elements 8, which are commonly known as tapes and which define slit shaped apertures 9 between adjacent tapes 8. The aperture grill 10 is supported on a metallic frame 6 which includes two support members 2, 3 which are coupled together by two frame members 4,5. The aperture grill 10 is welded to the support members 2, 3 at opposite edges so that the tapes 8 extend from the support member 2 to the support member 3.

The color selection mechanism 1 also includes two damper wires 12 which are mounted by mounting members 14 to the frame members 4, 5 so that the damper wires 12 are stretched across the tapes 8, as shown in FIG. 1. The damper wires 12 are stretched across the tapes 8 such that the damper wires 12 are in contact with each of the tapes 8 (see FIG. 2) to minimize vibration of the tapes 8 when the color selection mechanism is installed in a CRT. This is especially important in situations where the color selection mechanism is located near a speaker. For example, in a television or a computer monitor with attached speakers, as the sound from the speakers tends to induce vibration of the tapes 8. This vibration results in distortion of the image on the CRT if the damper wires 12 are not present.

In addition, the color selection mechanism 1 includes four spring loaded clips 15 mounted to each of the support members 2, 3 and the frame members 4, 5 by spring holders 13. The spring clips 15 permit mounting of the colour selection mechanism within a CRT.

Each of the support members 2, 3 is formed with a radius of curvature R in the Z direction, as shown in FIG. 3. In conventional colour selection mechanisms for conventional CRTs, the radius of curvature R was typically of the order of 1000 mm or less. Therefore, the radius of curvature was sufficiently small to ensure that the damper wires 12 were in contact with all of the tapes 8 even if there was an error in the alignment of one of the tapes. For example, if one of the tapes was twisted.

However, more recently, there has been a trend towards flat screen CRTs in which the radius of the curvature is at least 4000 mm and can be as high as 8000 mm, or greater. With a large radius of curvature such as this, small errors in alignment of the tapes 8 (for example, twisting of the tapes 8) can cause the damper wires not to touch tapes that are adjacent to the twisted tapes. This is a particular problem at the edges of the aperture grill where the edge tapes 8A are wider to provide additional support for the damper wires 12 at the edges of the aperture grill 10 adjacent to the damper wire supports 14. Typically, the edge tape 8A at each side of the aperture grill is approximately ten times the width of the other tapes forming the aperture grill. Hence, a small twisting of one of the edge tapes 8A can cause the damper wires 12 not to contact tapes 8B adjacent to the edge tapes 8A, as shown in FIG. 4.

Therefore, this can result in vibration of the tapes 8B not contacted by the damper wires during use which can result in distortion of the image on the CRT.

SUMMARY OF THE INVENTION

In accordance with a first aspect of the present invention, there is provided a color selection mechanism for a color CRT which includes a frame to which a color selection electrode thin plate is to be applied, and a color selection electrode thin plate, characterized in that a surface of said frame to which said color selection electrode thin plate is to be applied is formed from a face represented by a first and a second function in a longitudinal direction from the center of said frame, and said surface is leftwardly and rightwardly symmetrical with respect to a center axis thereof.

Preferably, the first function is a polynomial of degree three or more.

Preferably, the second function is a polynomial of degree two.

Typically, the transition from the first to the second function occurs at 10 to 15 color selection electrode pitches inwardly from an edge of the color selection electrode thin plate.

In accordance with a second aspect of the present invention, there is provided a frame for a color selection mechanism for a color CRT, the frame being adapted to have a color selection thin plate attached thereto, and the frame comprising two spaced apart support members, the support members each having a mounting surface, each of the mounting surfaces having a central surface portion with a first radius of curvature and end surface portions with a second radius of curvature, the second radius of curvature being smaller than the first radius of curvature.

Typically, the end surface portions extend for less than approximately 30 mm from the end of the mounting surfaces, preferably for less than 20 mm, and most preferably, extend for between 5 mm to 15 mm from the end of the mounting surfaces.

Typically, the first radius of curvature is greater than or equal to 4000 mm and the second radius of curvature is less than 1000 mm. Preferably, the second radius of curvature is less than 500 mm.

In accordance with a third aspect of the present invention, there is provided a color selection mechanism for a color CRT comprising a frame in accordance with the second aspect of the invention, a color selection thin plate mounted on the mounting surfaces and a vibration reducing member extending across the color selection thin plate.

In accordance with a fourth aspect of the present invention, there is provided a cathode ray tube comprising a color selection mechanism in accordance with the first or the third aspect of the invention.

BRIEF DESCRIPTION OF THE DRAWINGS

An example of a frame for a color selection mechanism in accordance with the invention will now be described with reference to the accompanying drawings, in which.

DETAILED DESCRIPTION OF CERTAIN PREFERRED EMBODIMENTS OF THE INVENTION

As described above, FIG. 1 shows a conventional color selection mechanism comprising an aperture grill 10 mounted on support members 2,3 of a frame and having damper wires 12 extending across the aperture grill 10.

Figure 1:
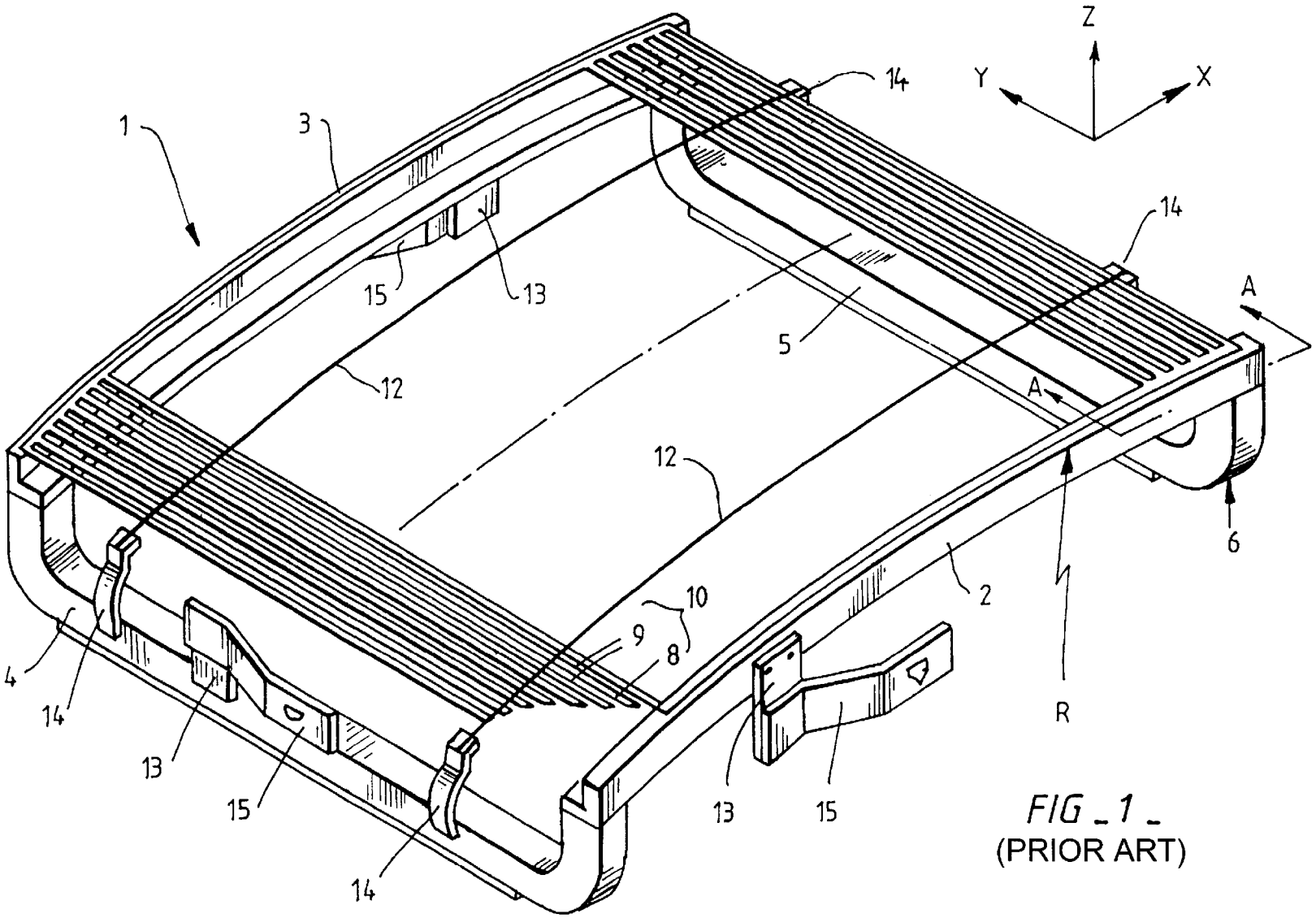
FIG 1 (PRIOR ART)
FIG. 1 is a perspective view of a conventional color selection mechanism.
Figure 2:
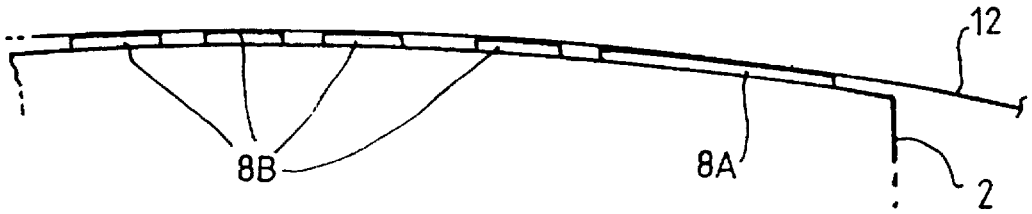
FIG 2 (PRIOR ART)
FIG. 2 is a side view along the line AA of FIG. 1.
Figure 3:
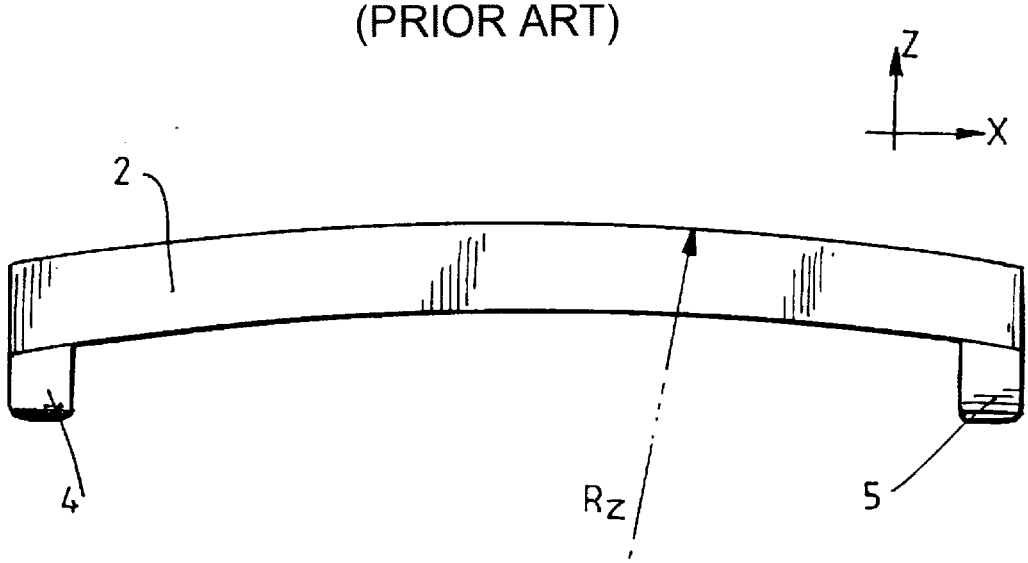
FIG 3 (PRIOR ART)
FIG. 3 is a side view of a conventional frame for a color selection mechanism.

FIG. 2 is a detailed end view along the line AA of FIG. 1. From FIG. 2 it can be seen that the edge tape 8A is considerably wider than the other tapes 8B forming the aperture grill 10. In this example, the support member 2 has a relatively large radius of curvature $R_Z$ (see FIG. 3) and typically, greater than 4000 mm.

In FIG. 2, it can be seen that all of the tapes 8A, 8B are aligned correctly and so the damper wire 12 contacts all of the tapes 8A, 8B to minimize vibration of the tapes 8A, 8B.

Figure 4:
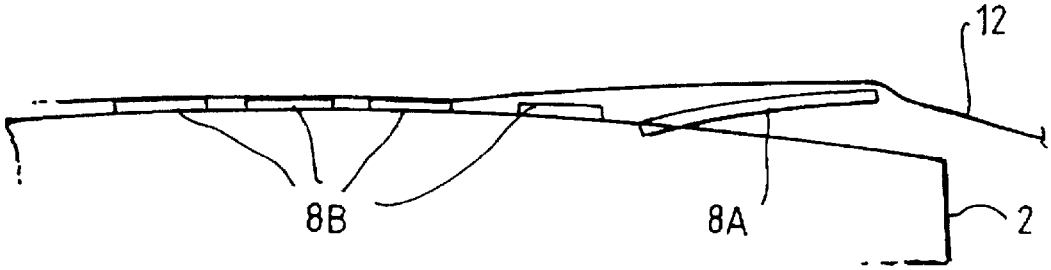
FIG 4 (PRIOR ART)
FIG. 4 is a side view along the line AA of FIG. 1 with a twisted edge tape.

However, the edge tape 8A is particularly prone to misalignment for example, due to twisting and such a situation is shown in FIG. 4. Here it can be seen that the edge tape 8A is twisted and that this causes the damper wire 12 to not be in contact with the tape 8B immediately adjacent to the tape 8A. Hence, tape 8B will not be damped by the damper wire 12 and this is likely to lead to distortion of an image on the CRT in which the color selection mechanism is mounted.

Figure 5:
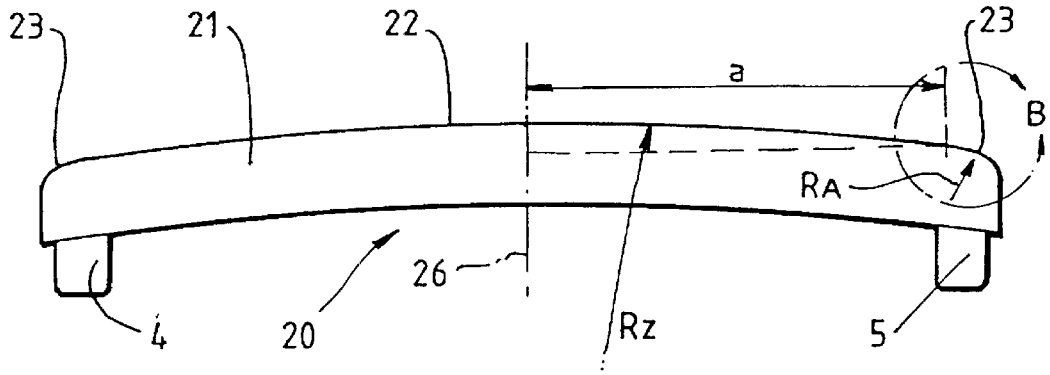
FIG. 5 is a side view of a frame for a color selection mechanism in accordance with the invention.

However, the invention alleviates this problem by providing a frame 20 for a color selection mechanism in which the mounting surfaces of the support members 2, 3 have a smaller radius of curvature at the edge of the mounting surfaces, as shown in FIG. 5. The frame 20 comprises intermediate members 4, 5 with two support members 21 (only one shown). The support members 21 have a mounting surface to which the aperture grill 10 is attached. As shown in FIG. 5, the mounting surface comprises a central surface portion 22 and two end surface portions 23. The radius of curvature of the central surface portion 22 is the normal radius of curvature for a flat screen CRT. Typically, this is a radius of curvature of at least 4000 mm.

However, the radius of curvatures of the end surface portions 23 are smaller and is typically less than 1000 mm and preferably, less than 500 mm.

Figure 6:
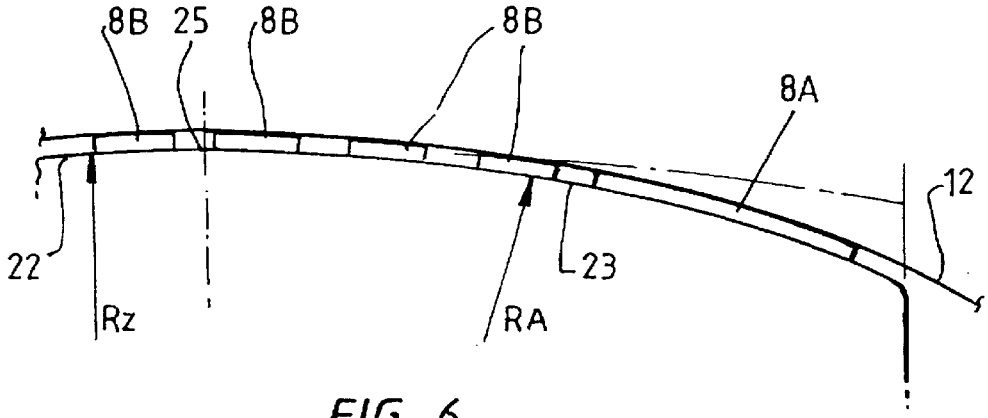
FIG. 6 is a detailed view of section B of FIG. 5.

FIG. 6 shows an exploded end view of section B in FIG. 5. Here it can be seen that the radius of curvature $R_A$ of the end surface portion 23 extends from the edge tape 8A of the aperture grill 10 inwards for a number of tapes 8B until a transition zone 25 is reached. At the transition zone 25 the radius of curvature changes to $R_Z$. This is the radius of curvature of the central surface portion 22.

Typically, the radius of curvature $R_Z$ of the central surface portion 22 is given by the following equation:

$$R_Z=M_1X^2+M_2X^4+M_3X^6$$

where $M_1$, $M_2$ and $M_3$ are constants and X is the distance along the x-axis from central axis 26 of the point on the surface 22 to be determined.

Typically, the radius of curvature $R_A$ of the end surface portions 23 is given by the following equation:

$$R_A{}^2=(X-r)^2+(Z+s)^2$$

Where $|X|>a$ (a is shown in FIG. 5 and is the distance from the center of the support members 21 to the transition zone 25 in the X direction, X is as defined above, Z is the distance along the z-axis of the point on the surface 23 to be determined, and r and s are the x and z co-ordinates respectively of the center of the circle with radius $R_A$.

Typical examples of $R_Z$ and $R_A$ for a 21 inch CRT are $R_Z$=6800 mm and $R_A$=263 mm with the transition zone 25 being 183 mm from the central axis 26 of the support members 21.

It can be seen from FIG. 5 that due to the smaller radius of curvature $R_A$ at the end surface portions 23, a minor misalignment of the edge tape 8A is less likely to cause the damper wire 12 not to contact adjacent tapes 8B. Therefore, a color selection mechanism using the frame 20 in accordance with the invention has the advantage of having a greater margin for error in alignment of the edge tapes 8A and so is less likely to suffer distortion of the image on the CRT due to vibration of the tapes 8B.

We claim:

1. A color selection mechanism for a color CRT which includes:

a frame to which a color selection electrode thin plate is to be applied, and a color selection electrode thin plate, characterized in that a surface of said frame to which said color selection electrode thin plate is to be applied is formed from a face represented by a first and a second function in a longitudinal direction from the center of said frame wherein the first function is a polynomial of a degree of three or more and the second function is a polynomial with a degree of two, and said surface is substantially symmetrical with respect to a center axis thereof.

2. A color selection mechanism according to claim 1, wherein the transition from the first function to the second function occurs at less than approximately 30 mm inwardly from the edge of the color selection electrode thin plate.

3. A frame for a color selection mechanism for a color CRT, the frame being adapted to have a color selection thin plate attached thereto, and the frame comprising two spaced apart support members, the support members each having a mounting surface, each of the mounting surfaces having a central surface portion with a first radius of curvature defined by a first polynomial equation having a degree of three or more and end surface portions with a second radius of curvature defined by a second polynomial equation having a degree of two, the second radius of curvature being smaller than the first radius of curvature.

4. A frame according to claim 3, wherein the end surface portions extend for less than approximately 30 mm from the end of the mounting surfaces.

5. A frame according to claim 4, wherein the end surface portions extend for less than approximately 20 mm from the end of the mounting surfaces.

6. A frame according to claim 5, wherein the end surface portions extend for between 5 mm to 15 mm from the end of the mounting surfaces.

7. A frame according to claim 3, wherein the first radius of curvature is greater than or equal to 4000 mm and the second radius of curvature is less than 1000 mm.

8. A frame according to claim 7, wherein the second radius of curvature is less than 500 mm.

9. A color selection mechanism for a color CRT comprising a frame in accordance with claim 3, a color selection thin plate mounted on the mounting surfaces and a vibration reducing member extending across the color selection thin plate.

10. A cathode ray tube comprising a color selection mechanism in accordance with claim 1.

11. A cathode ray tube comprising a color selection mechanism in accordance with claim 9.

* * * * *